US010473414B1

(12) United States Patent
Curry

(10) Patent No.: US 10,473,414 B1
(45) Date of Patent: Nov. 12, 2019

(54) MAGAZINE CATCH

(71) Applicant: Smith & Wesson Inc., Springfield, MA (US)

(72) Inventor: Brett Curry, Monson, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/452,612

(22) Filed: Jun. 26, 2019

Related U.S. Application Data

(60) Provisional application No. 62/691,858, filed on Jun. 29, 2018.

(51) Int. Cl.
*F41A 9/61* (2006.01)
*F41A 9/59* (2006.01)
*F41A 35/06* (2006.01)

(52) U.S. Cl.
CPC ..... *F41A 9/59* (2013.01); *F41A 35/06* (2013.01)

(58) Field of Classification Search
CPC ..... F41A 9/59; F41A 17/38; F41A 35/06
See application file for complete search history.

(56) References Cited

U.S. PATENT DOCUMENTS 4,236,337 A * 12/1980 Beretta ..... F41A 35/06 42/7
4,521,985 A * 6/1985 Smith ..... F41A 35/06 42/7
4,573,280 A * 3/1986 Malhotra ..... F41A 17/38 42/7
4,599,818 A * 7/1986 Fedora ..... F41A 35/06 42/7
4,713,902 A 12/1987 Wigton
4,759,144 A 7/1988 Egan et al.
4,949,492 A 8/1990 Clifton, Jr.
5,058,301 A 10/1991 Lishness et al.
6,141,895 A * 11/2000 Rost ..... F41A 17/38 42/6
8,166,691 B1 * 5/2012 Karfiol ..... F41A 35/06 42/6
9,964,372 B1 * 5/2018 O'Clair ..... F41A 9/59

FOREIGN PATENT DOCUMENTS

DE 672094 C * 2/1939 ..... F41A 17/38
EP 0364408 A1 * 4/1990 ..... F41A 17/38

* cited by examiner

*Primary Examiner* — Gabriel J. Klein
(74) *Attorney, Agent, or Firm* — John A. Chionchio, Esq.; Ballard Spahr LLP

(57) ABSTRACT

A magazine catch uses a spring biased plunger captured within a housing to bias the housing into engagement with a magazine to retain the magazine within the firearm. The plunger has a projection which engages the frame of the firearm. The plunger is rotatable relatively to the housing to orient the projection in opposite directions and thus permits the magazine catch to be reversibly positioned within the frame.

12 Claims, 7 Drawing Sheets

MAGAZINE CATCH

CROSS REFERENCE TO RELATED APPLICATION

This application is based upon and claims priority to U.S. Provisional Application No. 62/691,858, filed Jun. 29, 2018 and hereby incorporated by reference in its entirety.

FIELD OF THE INVENTION

This invention concerns a magazine catch for semi-automatic pistols.

BACKGROUND

Prior art magazine catches used on automatic pistols such as the Model 1911 are not suitable for use with modern pistols having molded polymer frames. Such a magazine catch requires that an undercut slot be formed in the pistol frame surrounding the aperture which receives the magazine catch. This slot is engaged by the catch retaining mechanism to retain the catch within the frame. It is difficult and cost prohibitive to mold such a slot in a polymer frame. There is an opportunity to improve the design of polymer frame pistols with respect to the design and operation of the magazine catch.

SUMMARY

The invention concerns a magazine catch for a firearm. In one example embodiment the magazine catch comprises a housing having first and second ends oppositely disposed. The housing defines an actuating button positioned at the first end and a retaining head positioned at the second end. A dog is positioned on the retaining head. The dog is engageable with the magazine to retain the magazine within the firearm. A channel is defined by the housing. The channel extends lengthwise therealong. A first recess is positioned at the first end of the housing. A second recess is positioned at the second end of the housing. A plunger is received within the channel. A first end of the plunger is received within the first recess and a second end of the plunger is received within the second recess. The plunger is movable along its longitudinal axis within the channel. A projection extends from the plunger transversely to the longitudinal axis. A biasing spring acts between the housing and the plunger and biases the plunger toward the second recess.

By way of example the dog projects transversely from the housing. In an example embodiment, the housing defines a plurality of notches adjacent to the retaining head. Each notch is adapted to receive the projection. The plunger is rotatable about its longitudinal axis relatively to the housing so as to align the projection with any one of the plurality of notches. In a specific example embodiment the housing defines three notches.

Further by way of example the housing defines an aperture in the second end. The aperture provides access to the second end of the plunger. In an example embodiment the second end of the plunger defines a slot oriented transversely to the longitudinal axis of the plunger.

The invention further encompasses a firearm fed ammunition from a magazine. In one example embodiment the firearm comprises a frame defining a magazine well for receiving the magazine and an opening extending through the frame. The opening is positioned proximate to the magazine well. A magazine catch is received within the opening. In an example embodiment the magazine catch comprises a housing having first and second ends oppositely disposed. The housing defines an actuating button positioned at the first end and a retaining head positioned at the second end. A dog is positioned on the retaining head. The dog extends into the magazine well and is engageable with the magazine to retain the magazine within the magazine well. A channel is defined by the housing. The channel extends lengthwise therealong. A first recess is positioned at the first end of the housing. A second recess is positioned at the second end of the housing. A plunger is received within the channel. A first end of the plunger is received within the first recess and a second end of the plunger received within the second recess. The plunger being movable along its longitudinal axis within the channel. A projection extends from the plunger transversely to its longitudinal axis. A biasing spring acts between the housing and the plunger and biases the plunger toward the second recess and into engagement with the frame. The housing is movable transversely to the frame between a first position wherein the dog engages and retains the magazine within the magazine well, and a second position, wherein the dog is disengaged from the magazine, the biasing spring biasing the housing into the first position.

In an example embodiment the dog projects transversely from the housing. Further by way of example the housing defines a plurality of notches adjacent to the retaining head. Each notch is adapted to receive the projection. The plunger is rotatable about its longitudinal axis relatively to the housing so as to align the projection with any one of the plurality of notches. In a specific example embodiment the housing defines three notches. In a further example the housing defines an aperture in the second end. The aperture provides access to the second end of the plunger. In an example embodiment, the second end of the plunger defines a slot oriented transversely to the longitudinal axis of the plunger.

DETAILED DESCRIPTION

Figure 1:
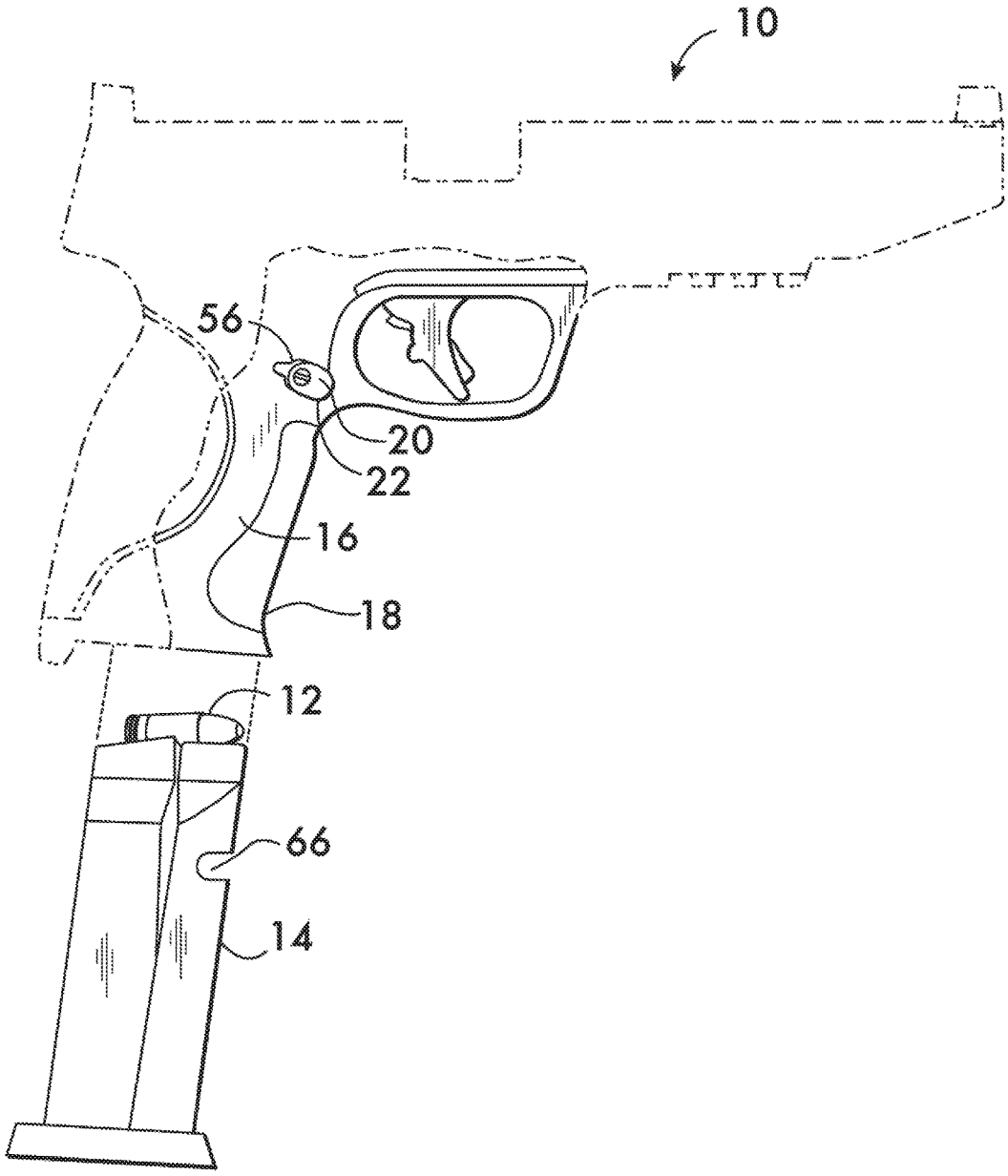
FIG. 1 is a right side view of an example firearm having an example magazine catch according to the invention.

FIG. 1 shows a firearm 10, in this example a semi-automatic pistol, fed ammunition 12 from a magazine 14 received within a magazine well 16 defined by the pistol's frame 18. An example magazine catch 20 is also located within the frame 18, the catch being received within an opening 22 extending through frame 18 and positioned proximate to the magazine well 16 (see also FIG. 6).

Figure 2:
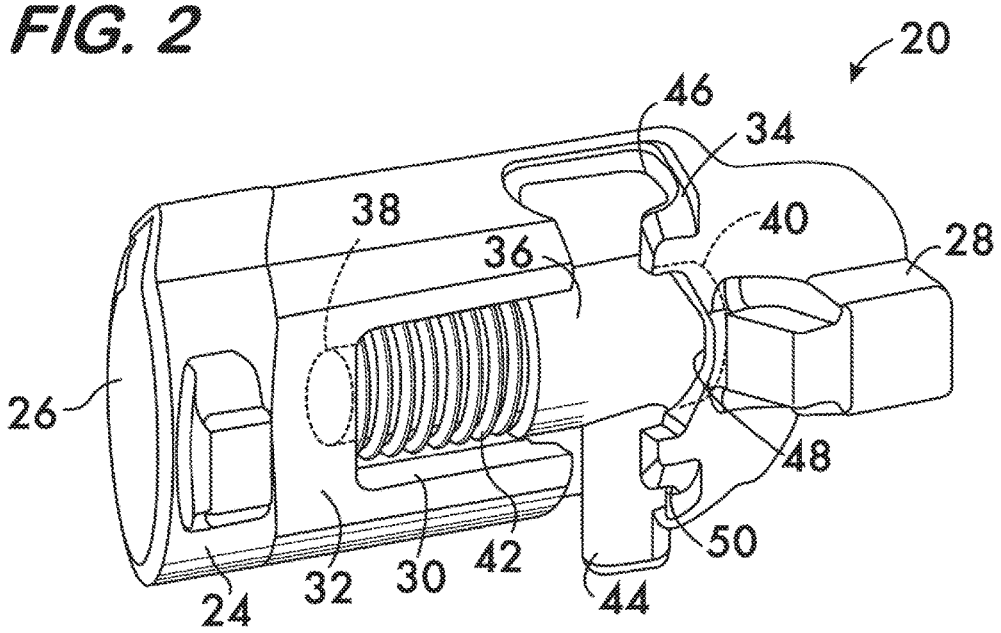
FIGS. 2 and 3 are isometric views of an example embodiment of a magazine catch according to the invention shown in different configurations.
Figure 3:
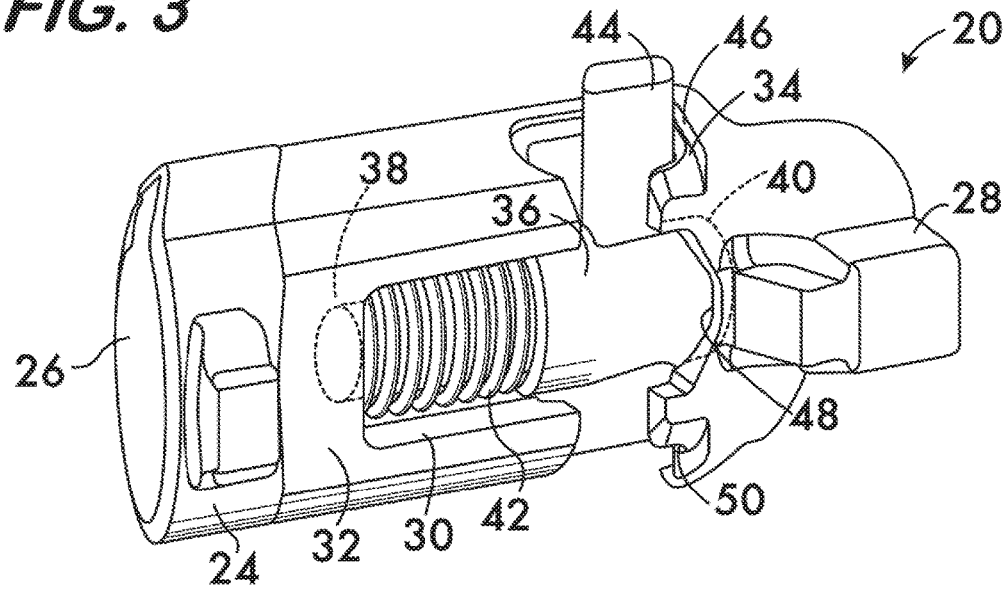

FIGS. 2 and 3 show isometric views of the example magazine catch 20 according to the invention. Catch 20 comprises a housing 24 having an actuating button 26 positioned at a first end and a retaining head 28 positioned at a second, opposite end thereof. Housing 24 defines a channel 30, the channel extending lengthwise along the housing and having first and second enclosed recesses 32 and 34 at opposite ends thereof. Channel 30 receives a plunger 36. Plunger 36 has a first end 38 received within the first recess 32, and a second end 40 received within the second recess 34. Plunger 36 has a length which permits it to move axially along the channel 30 while having its ends 38 and 40 retained to the housing 24 by the recesses 32 and 34. A biasing element, in this example, a coil spring 42, is mounted coaxially about plunger 36 and acts between the housing 24 and the plunger 36 to bias the plunger toward the retaining head 28.

Figure 4:
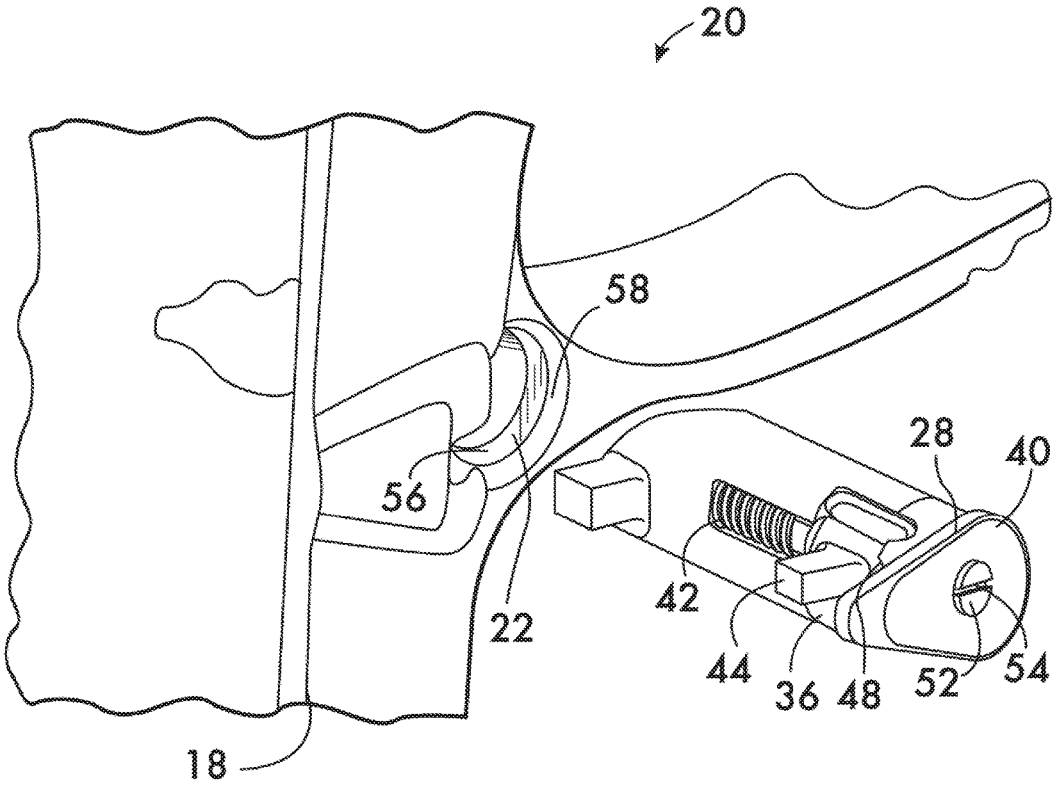
FIG. 4 is an isometric view illustrating assembly of the magazine catch shown in FIG. 1 into the frame of a pistol.

A projection 44 extends transversely from the plunger 36. Projection 44 is positioned toward the plunger's second end 40 and is engageable with any one of three notches 46, 48, and 50 located in housing 24 adjacent to the retaining head 28. Engagement between the projection 44 and the notches secures the rotational orientation of the plunger 36 within the channel 30 as shown by a comparison of FIGS. 2-4. The spring 42 biases the projection into engagement with the notches. As shown in FIG. 4, an aperture 52 is positioned within the retaining head 28 which allows access to the second end 40 of plunger 36 thereby permitting the plunger 36 to be moved axially within channel 30 against the force of its biasing spring 42 when a tool is inserted through aperture 52. The second end 40 of plunger 36 has a transverse slot 54 (see FIGS. 5 and 6) which receives the blade of a driver tool to permit the plunger to be rotated about its longitudinal axis to align the projection 44 (see also FIGS. 2-4) with any of the three notches 46, 48 and 50 as desired when the plunger 36 is moved axially to disengage it from the notches. Once assembled, the magazine catch 20 with its spring biased plunger 36 is a totally self-contained mechanism which can be assembled into the frame of a pistol as described below.

Figure 5:
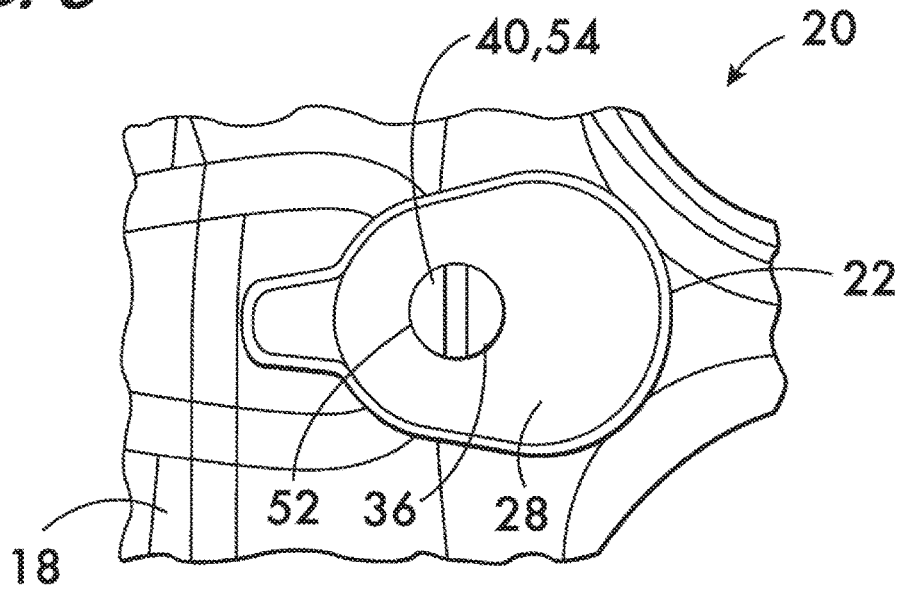
FIGS. 5 and 6 are plan views of a portion of the pistol frame shown in FIG. 1 on an enlarged scale illustrating further steps in the assembly of the magazine catch into the pistol frame.

FIG. 4 shows the first assembly step whereby the magazine catch 20 has its projection 44 engaged with the middle notch 48. This rotational orientation of the plunger 36 allows the projection 44 to align with a cut-out 56 in the opening 22 in the pistol frame 18 which receives the magazine catch 20. As shown in FIG. 5, catch 20, now properly aligned, is inserted actuator button 26 first (not visible) into the frame opening 22. The retaining head 28 is received in mating engagement with a receiving surface 58 (see FIG. 4) surrounding the frame opening 22. Engagement between the retaining head 28 and receiving surface 58 prevents the magazine catch 20 from passing though the frame opening 22 and into the magazine well 16 defined by the frame 18.

Figure 6:
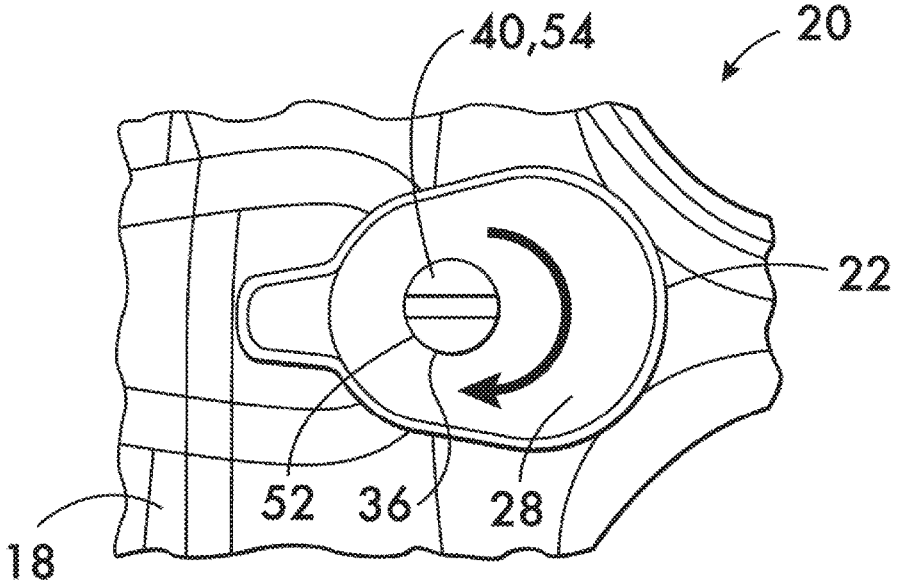
Figure 7:
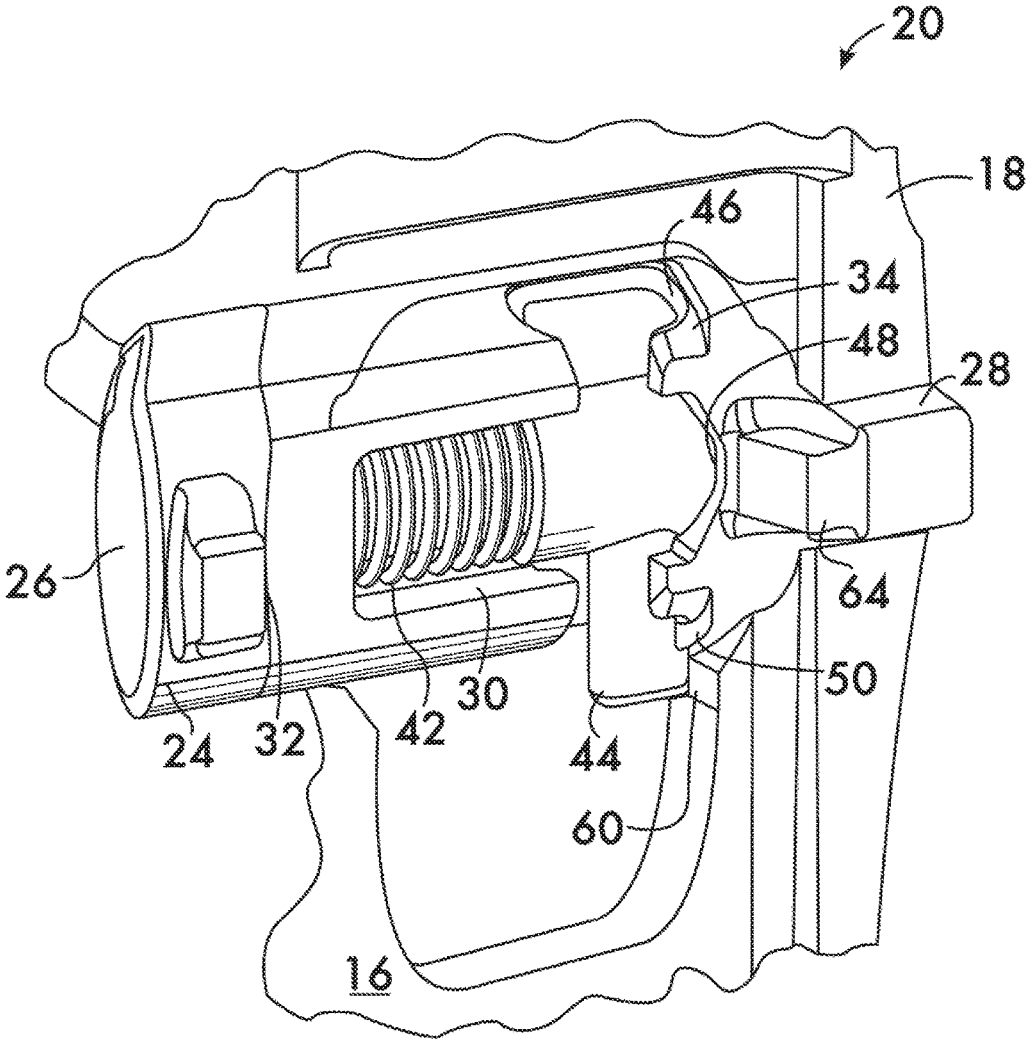
FIG. 7 is an isometric cut view of the interior of the magazine well of a pistol illustrating an assembled magazine catch.

As shown in FIG. 6, the plunger 36 is rotated clockwise by inserting a driver tool into the retaining head aperture 52. The driver tool engages the slot 54 to first move the plunger 36 axially relatively to the housing 24 (compressing spring 42) and thereby disengaging the projection 44 from the middle notch 48 (see also FIG. 4). The driver tool is then used to rotate the plunger 36 so that the projection 44 aligns with another of the notches, in this example notch 50 (see FIG. 7). The driver tool is then withdrawn, allowing the spring 42 to bias the plunger toward the retaining head 28 and engage projection 44 with notch 50. As shown in FIG. 7, this rotation orients the projection 44 so that it engages a reaction surface 60 on the frame 18 within the magazine well 16. The biasing spring 42, acting between the housing 24 and the plunger 36, forcibly pulls the retaining head 28 against its receiving surface 58 (see FIG. 4) through the reaction between the projection 44 and the reaction surface 60 within the magazine well 16. The magazine catch 20 may be readily removed by reversing the assembly steps. The ability to engage the projection 44 with the two notches 46 and 50 which are 90° apart allows for convenient reversibility, enabling the magazine catch 20 to be inserted into the frame 18 from either side.

Figure 8:
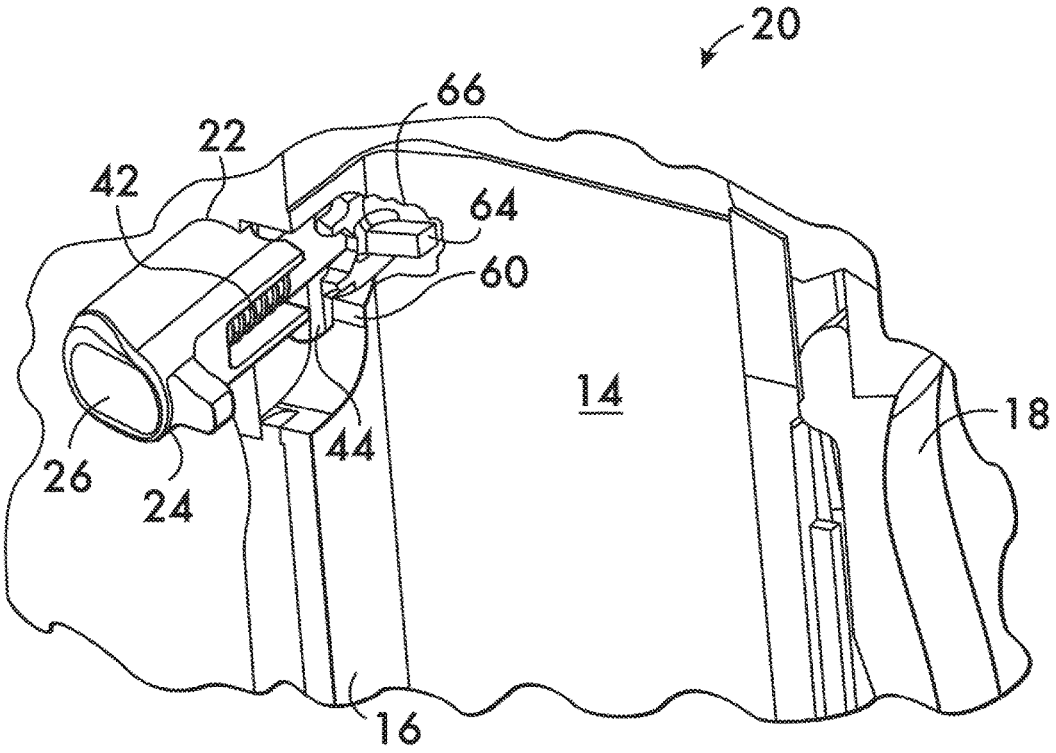
FIGS. 8 and 9 are isometric cut views of the interior of the magazine well of a pistol illustrating operation of an example magazine catch according to the invention.
Figure 9:
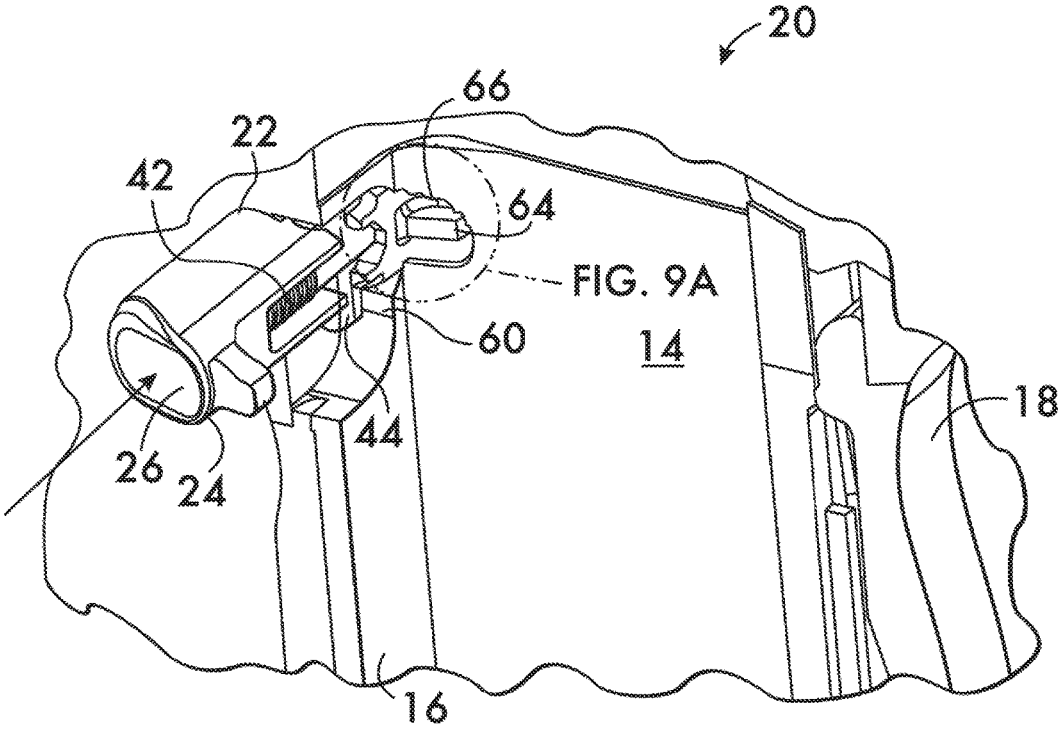
Figure 9A:
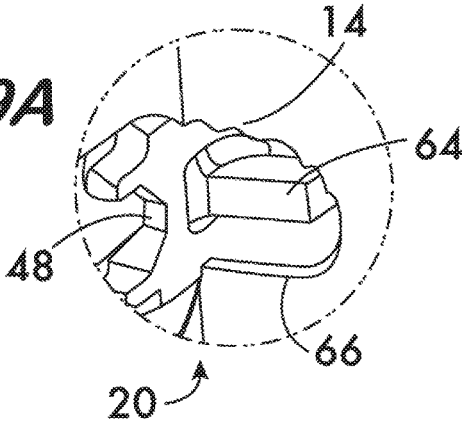
FIG. 9A is an isometric view of a portion of FIG. 9 on an enlarged scale.

FIGS. 8 and 9 illustrate the magazine catch 20 in operation. As shown in FIG. 8, a magazine 14 (represented by a single side wall for clarity) is received within the magazine well 16 of the frame 18. A retaining dog 64 positioned on the retaining head extends into the magazine well 16 and engages an opening 66 in the magazine 14 (see also FIG. 1) to retain the magazine within the magazine well. The dog 64 projects transversely from the housing 24. FIGS. 9 and 9A show the magazine 14 being released by the shooter pushing on the actuation button 26, causing the housing to move through the opening 22, in this example, to the right. Motion of the housing is resisted by the biasing force of spring 42 acting against the projection 44 which in turn acts against reaction surface 60. Motion of the housing 24 to the right disengages the dog 64 from the opening 66 in the magazine 14 allowing the magazine to drop out of the magazine well 16 or otherwise be removed therefrom.

It is expected that magazine catches according to the invention will provide design improvements to pistols, especially those comprising molded polymer frames because the design does not require complex frame undercuts and can use the standard "pull" pocket features common to molding practice.

What is claimed is:

1. A magazine catch for a firearm, said magazine catch comprising:

a housing having first and second ends oppositely disposed, said housing defining an actuating button positioned at said first end and a retaining head positioned at said second end;

a dog positioned on said retaining head, said dog being engageable with said magazine to retain said magazine within said firearm;

a channel defined by said housing and extending lengthwise therealong;

a longitudinal slot in communication with said channel, said longitudinal slot being closed lengthwise at opposite ends;

a first recess positioned at said first end of said housing;

a second recess positioned at said second end of said housing;

a plunger received within said channel, a first end of said plunger received within said first recess and a second end of said plunger received within said second recess, said plunger being movable along a longitudinal axis thereof within said channel;

a projection extending from said plunger transversely to said longitudinal axis thereof, said projection extending out from said channel through said longitudinal slot;

a biasing spring acting between said housing and said plunger and biasing said plunger toward said second recess.

2. The magazine catch according to claim 1, wherein said dog projects transversely from said housing.

3. The magazine catch according to claim 1, wherein said housing defines a plurality of notches adjacent to said retaining head, each said notch adapted to receive said projection, said plunger being rotatable about said longitudinal axis relatively to said housing so as to align said projection with any one of said plurality of notches.

4. The magazine catch according to claim 3, wherein said housing defines three said notches.

5. The magazine catch according to claim 3, wherein said housing further defines an aperture in said second end, said aperture providing access to said second end of said plunger.

6. The magazine catch according to claim 5, wherein said second end of said plunger defines a transverse slot oriented transversely to said longitudinal axis of said plunger.

7. A firearm fed ammunition from a magazine, said firearm comprising:

a frame defining a magazine well for receiving said magazine and an opening extending through said frame, said opening being positioned proximate to said magazine well;

a magazine catch received within said opening, said magazine catch comprising:

a housing having first and second ends oppositely disposed, said housing defining an actuating button positioned at said first end and a retaining head positioned at said second end;

a dog positioned on said retaining head, said dog extending into said magazine well and being engageable with said magazine to retain said magazine within said magazine well;

a channel defined by said housing and extending lengthwise therealong;

a longitudinal slot in communication with said channel, said longitudinal slot being closed lengthwise at opposite ends;

a first recess positioned at said first end of said housing;

a second recess positioned at said second end of said housing;

a plunger received within said channel, a first end of said plunger received within said first recess and a second end of said plunger received within said second recess, said plunger being movable along a longitudinal axis thereof within said channel;

a projection extending from said plunger transversely to said longitudinal axis thereof, said projection extending out from said channel through said longitudinal slot;

a biasing spring acting between said housing and said plunger and biasing said plunger toward said second recess and into engagement with said frame; wherein said housing is movable transversely to said frame between a first position wherein said dog engages and retains said magazine within said magazine well, and a second position wherein said dog is disengaged from said magazine, said biasing spring biasing said housing into said first position.

8. The firearm according to claim 7, wherein said dog projects transversely from said housing.

9. The magazine catch according to claim 7, wherein said housing defines a plurality of notches adjacent to said retaining head, each said notch adapted to receive said projection, said plunger being rotatable about said longitudinal axis relatively to said housing so as to align said projection with any one of said plurality of notches.

10. The firearm according to claim 9, wherein said housing defines three said notches.

11. The firearm according to claim 9, wherein said housing further defines an aperture in said second end, said aperture providing access to said second end of said plunger.

12. The firearm according to claim 11, wherein said-second end of said plunger defines a transverse slot oriented transversely to said longitudinal axis of said plunger.

* * * * *